United States Patent [19]

Obermeier et al.

[11] 3,973,797

[45] Aug. 10, 1976

[54] SEAT BACKREST HAVING AN ADJUSTABLE LUMBAR SUPPORT

[75] Inventors: Albert Anthony Obermeier, Waterloo; James Edward Thompson, Cedar Falls, both of Iowa

[73] Assignee: Deere & Company, Moline, Ill.

[22] Filed: Mar. 31, 1975

[21] Appl. No.: 563,591

[52] U.S. Cl. ..... 297/284
[51] Int. Cl.[2] ..... A47C 3/00
[58] Field of Search ..... 297/284

[56] References Cited

UNITED STATES PATENTS

| | | | |
|---|---|---|---|
| 2,097,541 | 11/1937 | Turner | 297/284 |
| 2,991,124 | 7/1961 | Schwarz | 297/284 |
| 3,215,468 | 11/1965 | Swenson et al. | 297/284 |
| 3,403,938 | 10/1968 | Cramer et al. | 297/284 X |
| 3,762,769 | 10/1973 | Poschl | 297/284 |

*Primary Examiner*—James C. Mitchell

[57] ABSTRACT

A seat backrest having a contourable upholstered portion supported by a rigid frame includes means to impart a curvature to the upholstered portion to produce a desired supporting contour in the lumbar area of the seat's occupant. The contour-producing means includes a lumbar pad, a resilient member connecting the lumbar pad to the frame, and means operable from the side of the backrest for moving and holding the connecting member in a plurality of positions.

4 Claims, 2 Drawing Figures

SEAT BACKREST HAVING AN ADJUSTABLE LUMBAR SUPPORT

BACKGROUND OF THE INVENTION

The present invention relates generally to vehicle seats and more particularly to a seat backrest whose contour is adjustable to conform to the lumbar contour of a particular occupant.

In the past, seats having contourable backrests made use of screw and bushing combinations positioned at the center of the back or the side of the seat which were not easily adjustable by a seated occupant and which required multi-turn adjustments before the desired contour could be obtained.

SUMMARY OF THE INVENTION

It is a general object of the present invention to provide an improved vehicle seat backrest having an adjustable lumbar support which may be easily adjusted at the side of the backrest through the full range of adjustment in one motion by a seated occupant to fit his personal contour. Detent means are provided to eliminate the need to depend on the frictional hold of a screw in order to maintain a particular setting of the lumbar support.

The above and additional objects and advantages of the present invention will become apparent to those skilled in the art from a consideration of the following detailed description of a preferred embodiment of the invention when taken in conjunction with the accompanying drawings.

DESCRIPTION OF THE PREFERRED EMBODIMENT

Figure 1:
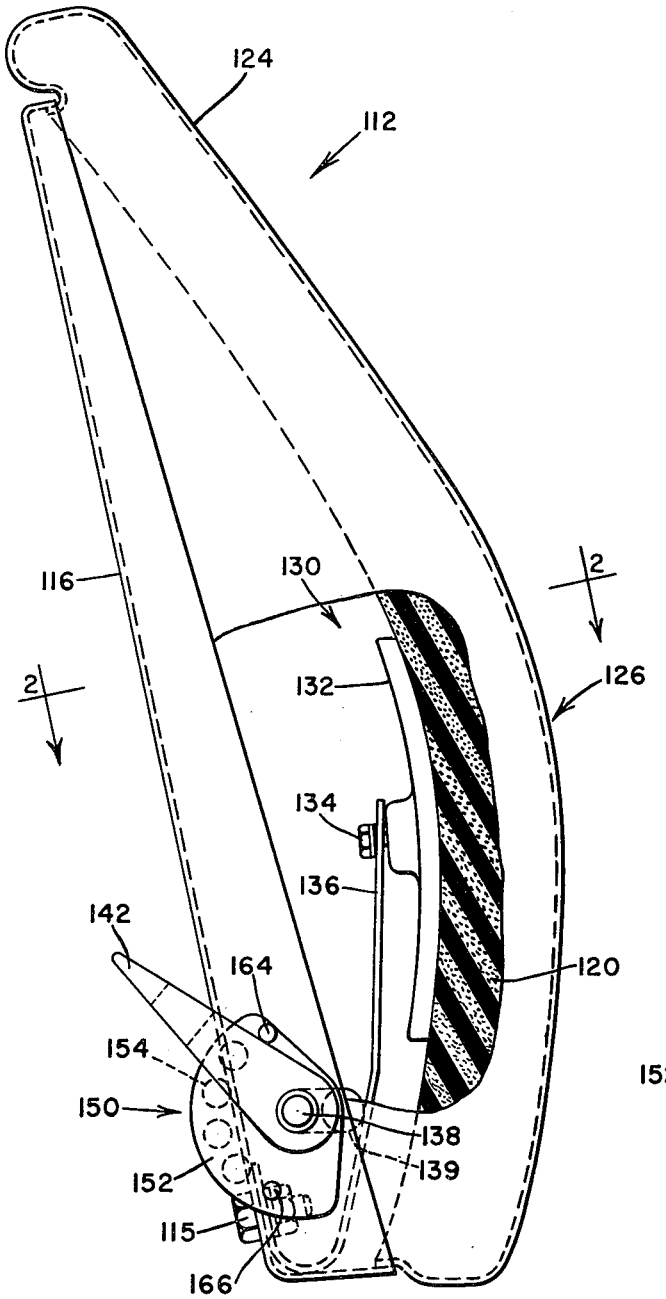
FIG. 1 is a partial section side view of a seat backrest embodying the present invention.
Figure 2:
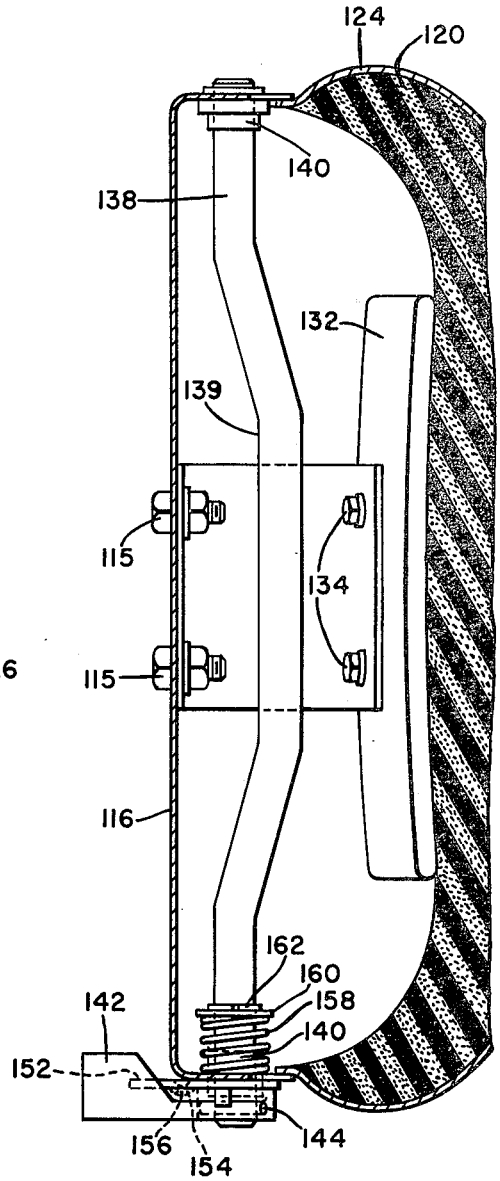
FIG. 2 is a section taken along the line 2—2 of FIG. 1 of the alternate embodiment in an alternate position.

Referring now to the drawings, there is shown a seat backrest 112 having a rigid frame 116 and a resilient elastomeric layer 120 which is covered by a flexible elastic covering 124 of a fabric or vinyl material.

An adjustable lumbar support, shown at 130, imparts a curvature to the flexible elastic covering 124 in the lower portion of the backrest 112 shown as a lumbar area 126. The adjustable lumbar support 130 includes a lumbar pad 132 attached by screws 134 to a cantilevered resilient member 136 which is attached by nuts and bolts 115 to the frame 116. The cantilevered resilient member 136 is pre-stressed so as to spring back towards the back frame 116.

To make the lumbar support 130 adjustable, there is provided an eccentric bar 138 pivoting on a pair of bushings 140 nonrotatably mounted in flanges of the frame 116. The eccentric bar 138 includes an offset crank portion 139 which cams and across the width of the cantilevered resilient member 136 sufficiently remote from the lumbar pad 132 so as to allow substantial flexing of the member 136 to absorb shocks.

To permit operation by the occupant of the seat, an adjusting lever 142 on the right hand exterior of the frame 116 is secured by a pin 144 to one end of the eccentric bar 138.

To hold the cantilevered resilient member 136 in a plurality of positions, a detent means 150 is provided.

The detent means 150 includes a detent plate 152 attached perpendicular to the frame 116 and having a plurality of protrusions 154 which are designed to engage an indentation 156 in the adjusting lever 142. A spring 158 encircling the eccentric bar 138 is positioned interiorly of frame 116 and is compressed between the frame 116 and a thrust washer 160 which abuts against a snap ring 162 mounted in a groove in the eccentric bar 138. Stop pins 164 and 166 in the detent plate 152 act to restrict the travel of the adjusting lever 142.

In operation, the occupant of the seat reaches back and rotates the adjusting lever 142 upward (clockwise as viewed from the right) in one motion for forward movement of the lumbar area 126 or downward (counterclockwise as viewed from the right) in one motion for backward movement.

Forward movement of the lumbar area 126 is afforded by the upward rotative action of the adjusting lever 142 between stop pins 166 and 164. The rotative action of the crank portion 139 of the eccentric bar 138 camming against the cantilevered resilient member 136 moves the lumbar pad 132 forward against the resilient elastomeric layer 120 and the flexible elastic covering 124. Rearward movement occurs as the crank portion 139 rotates backward allowing the cantilevered resilient member 136 to spring back which further allows the resilient elastomeric layer 120 and the flexible elastic covering 124 to move rearward.

As the adjusting lever 142 is rotated, the lever indentation 156 cams out of engagement with the protrusions 154 and causes the spring 158 to be compressed due to axial movement of the eccentric bar 138 in the bushings 140. At each detent holding position, of which there are five, the spring 158 expands and urges the lever indentation 156 into engagement with one of the protrusions 154 so as to prevent movement due to loading on the crank portion 139 of the eccentric bar 138 by the occupant of the seat leaning against the lumbar area 126 or by the spring back load of the cantilevered resilient member 136.

Thus, a vehicle seat having an adjustable lumbar support has been presented wherein the occupant of the seat may adjust the lumbar contour in one motion at the side of the seat while seated. Further, the cantilevered resilient member 136 provides increasingly resilient support for the occupant's lumbar area which is particularly important for absorbing shocks in vehicles used to traverse rough terrain.

While the invention has been described in conjunction with a specific embodiment, it is to be understood that many alternatives, modifications, and variations will be apparent to those skilled in the art in light of the aforegoing description. Accordingly, it is intended to embrace all such alternatives, modifications, and variations that fall within the spirit and scope of the appended claims.

We claim:

1. A seat back rest comprising: a rigid frame supporting a contourable portion constituted by a flexible covering and an elastomeric layer interposed between the covering and the frame; and means between the frame and the covering to impart a curvature to the covering to produce a desired contour including a lumbar pad, a cantilevered resilient member rigidly attached to the base of the frame at one end and to the lumbar pad at the other end, an eccentric bar pivotally mounted in the frame proximate the base of the frame for pivotation about a horizontal axis and having an offset crank portion parallel to the horizontal axis abutting the resilient member and rotatable toward the base of the frame for camming the resilient member away from the frame, said eccentric bar having an adjusting lever attached to one end, said adjusting lever substantially longer than the offset of the crank portion and position detent means for holding the eccentric bar in a plurality of positions.

2. The invention as claimed in claim 1 wherein the flexible covering is elastic and the elastomeric layer is resilient to accommodate the plurality of positions of the lumbar pad.

3. The invention as claimed in claim 1 wherein the detent means includes a detent plate secured to the frame and having a plurality of convolutions, the adjusting lever means having a convolution for engagement with a convolution of the detent plate, and spring means for urging the convolution in the adjusting lever into engagement with a convolution of the detent plate.

4. The invention as claimed in claim 1 wherein the resilient member includes a formed flat-leaf spring having a predetermined horizontal width and the crank portion has a horizontal length substantially equal to the predetermined width and continuously abuts the leaf spring across the predetermined width.

* * * * *